US005259492A

United States Patent [19]

Jaminet

[11] Patent Number: 5,259,492

[45] Date of Patent: Nov. 9, 1993

[54] DUAL BELT LINEAR HANDRAIL DRIVE

[75] Inventor: Jerome Jaminet, Glastonbury, Conn.

[73] Assignee: Otis Elevator Company, Farmington, Conn.

[21] Appl. No.: 998,510

[22] Filed: Dec. 30, 1992

[51] Int. Cl.[5] ..... B66B 23/04

[52] U.S. Cl. ..... 198/335; 198/833

[58] Field of Search ..... 198/331, 335, 833

[56] References Cited

U.S. PATENT DOCUMENTS

| | | | |
|---|---|---|---|
| 3,283,878 | 11/1966 | Rissler | 198/335 |
| 3,381,799 | 5/1968 | Havelka | 198/833 |
| 3,749,224 | 7/1973 | Engeler | 198/335 |
| 5,117,960 | 6/1992 | Ahls et al. | 198/335 |

FOREIGN PATENT DOCUMENTS

| | | | |
|---|---|---|---|
| 1481181 | 5/1989 | U.S.S.R. | 198/331 |
| 1567498 | 5/1990 | U.S.S.R. | 198/335 |

*Primary Examiner*—Joseph E. Valenza

*Attorney, Agent, or Firm*—William W. Jones; Richard D. Getz

[57] ABSTRACT

The moving handrails of an escalator or moving walkway are driven by a pair of linear powered belts which are positioned along a linear portion of the return path of travel of the escalator. Each handrail drive system includes a pair of drive belts which are entrained about a drive sprocket and an idler sprocket. The drive belts have toothed surfaces which engage teeth on the sprockets. The sides of the belts away from the toothed surfaces are smooth. The belts are moved along a rectilinear path which brings them into the underneath side of the returning handrail. A spreader forces the belts apart and into the side pockets on the handrail where they engage and drive the handrail. The drive system does not contact the outer surface of the handrail and does not move the handrail through a nip where it will bend.

5 Claims, 3 Drawing Sheets

DUAL BELT LINEAR HANDRAIL DRIVE

TECHNICAL FIELD

This invention relates to a linear drive system for a moving handrail on an escalator or moving walkway. More particularly, the drive system of this invention engages only the underneath surfaces on the handrail.

BACKGROUND ART

Moving handrails in escalators and moving walkways can be driven with a number of different drive assemblies. An important feature, however, of any handrail drive assembly is that the handrail be driven at a speed which is very close to the speed of the steps or treads, and that the handrail stop moving when the steps or treads stop moving. This result is typically achieved by tying the handrail drive to the step drive by means of a drive chain which is driven by the step drive and which drives the handrail drive. The handrail may be driven by passing it through a roller nip; by a single biased driven roller; or by a belt or rollers which engage the inner surface of the handrail.

The use of a roller nip is not preferred since the rollers squeeze and deform the handrail. The exposed outer surface of the handrail can be damaged by this type of drive. An additional problem relating to a nip drive concerns the fact that the two opposite surfaces of the handrail will possess different coefficients of friction, whereby one of the rollers will typically slip on the handrail. The reason for this is that the underneath side of the handrail will be partially formed from a slippery or low coefficient of friction material so that it can slide easily over its guide rail. Additionally, a nip drive will cause a kink in the handrail as it passes through the nip, which lowers the operational life of the handrail.

Single biased drive rollers do not create some of the problems that a roller nip drive does, however, they still require arcuate deformation of the handrails as they pass over the drive roller, which will ultimately weaken the handrail. In addition, this type of drive will be rendered inefficient over time as the handrail stretches.

Handrail drives which contact only the inner or underneath surface of the handrail are desirable because they do not touch and cannot mar the external surface of the handrail on which the passengers rely. In addition, handrail drives which contact the handrail in a linear fashion are also highly desirable, because they do not subject the handrail to harmful bends or localized compression. Inner surface handrail drives have been proposed, but one problem that they all face relates to the fact, mentioned previously, that part of the inner surface of the handrail is intentionally made slippery so that it can slide over the handrail guide rail without generating excessive heat. How to ensure a sufficiently tight driving engagement between the drive mechanism and the handrail is the problem encountered. U.S. Pat. No. 3,283,878, granted Nov. 8, 1966 to L. R. Rissler discloses an inner surface handrail drive system which includes a drive belt that contacts the handrail through the newel portion of the escalator, and which relies on the inherent tension in the handrail as it passes over the newels to press the drive belt and handrail together. U.S. Pat. No. 5,117,960 granted Jun. 2, 1992 to H. W. Ahls, et al. discloses an inner surface linear handrail drive system which relies on a series of presser rolls to force the drive belt against the inner surface of the handrail. Both of the latter systems result in minimal damage to the handrail.

DISCLOSURE OF THE INVENTION

This invention relates to a moving handrail drive which engages the underneath side of the handrail, and which provides enhanced frictional engagement with the handrail. The drive is a linear drive that uses a drive belt system which engages the inner surfaces of the curved sides of the handrail. The drive belt system includes a pair of driving belts which are disposed side-by-side to each other, and which are entrained about a drive sprocket and an idler sprocket. The drive belts have inner toothed surfaces which engage complimentary teeth on the drive and idler sprockets. The drive belts are brought into alignment with the inner or underneath surface of the handrail in the return run, and then the drive belts are laterally spread apart from each other so that they will be forced into engagement with the inner curved sides of the handrail. While in the spread condition, the drive belts are driven by their drive sprocket so as to pull the handrail along its return path. An extended rectilinear engagement between the drive belts and the handrail is achieved, and the belt-to-handrail contact is limited to the higher coefficient of friction inner surfaces of the sides of the handrail. The outer surface of the handrail is not touched by the drive system.

It is therefore an object of this invention to provide a moving handrail drive system which does not subject the handrail to undesirable bending.

It is a further object of this invention to provide a handrail drive system of the character described which engages only the inner surface of the handrail.

It is another object of this invention to provide a handrail drive system of the character described which provides extended linear contact with the handrail.

These and other objects and advantages of the invention will become more readily apparent from the following detailed description of a preferred embodiment of the invention when taken in conjunction with the accompanying drawings, in which:

BEST MODE FOR CARRYING OUT THE INVENTION

Figure 1:
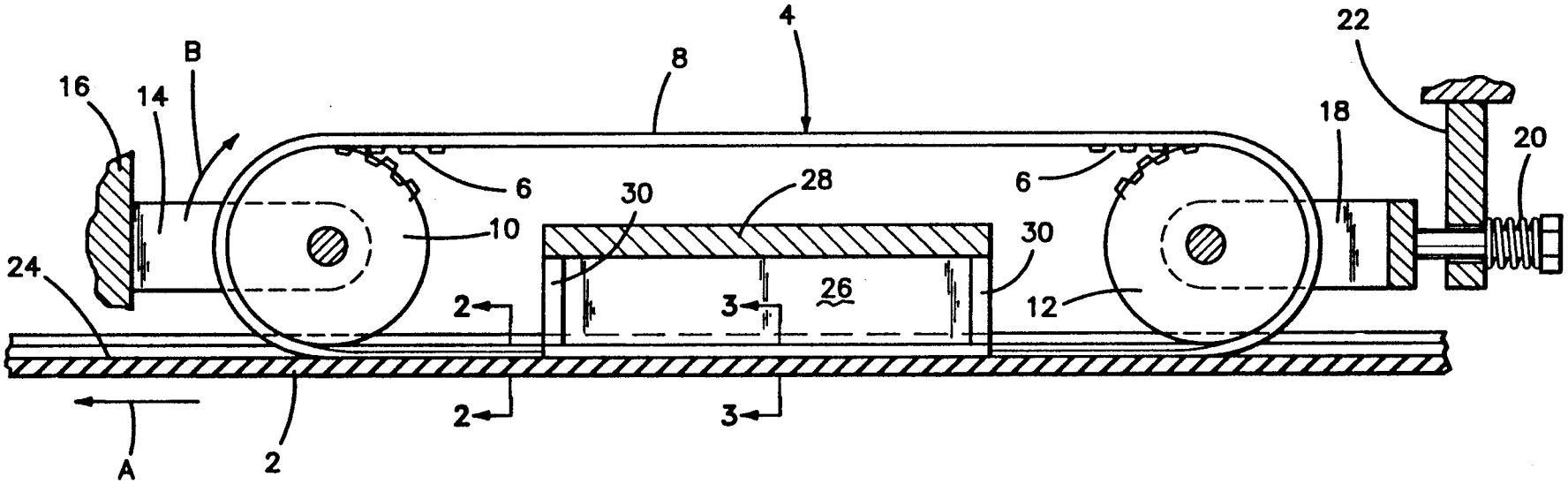
FIG. 1 is a side elevational view of a preferred embodiment of the handrail drive system of this invention.

Referring now to FIG. 1, there is shown in side elevation a portion of the return path of travel of an escalator or moving walkway handrail 2. The handrail 2 moves in the direction of the arrow A and is driven by a pair of adjacent drive belts 4 which have an inner toothed side 6 and an outer smooth side 8. The belts 4 are entrained over a toothed drive sprocket 10 and a toothed idler or tension sprocket 12 in a closed endless loop. The drive sprocket 10 is mounted on a fixed bracket 14 which is secured to the truss 16 of the conveyor, and is connected to the step drive by a drive chain (not shown) so as to rotate in the direction of the arrow B. The tension sprocket 12 is mounted on a yoke 18 which is biased by a spring 20 seated against a truss bracket 22 so as to maintain a predetermined amount of tension in the drive belts 4. The drive belts 4 are drawn against, or very close to, the inner surface 24 of the handrail 2 by the drive sprocket 10, and remain against, or very close to, the inner surface 24 of the handrail to the idler sprocket 12. A drive belt spreader 26 is mounted on a cross brace 28 on the truss, the spreader 26 extending downwardly from the brace 28 into the path of travel of the drive belts 4. Each end of the spreader 26 is tapered as at 30.

Figure 2:
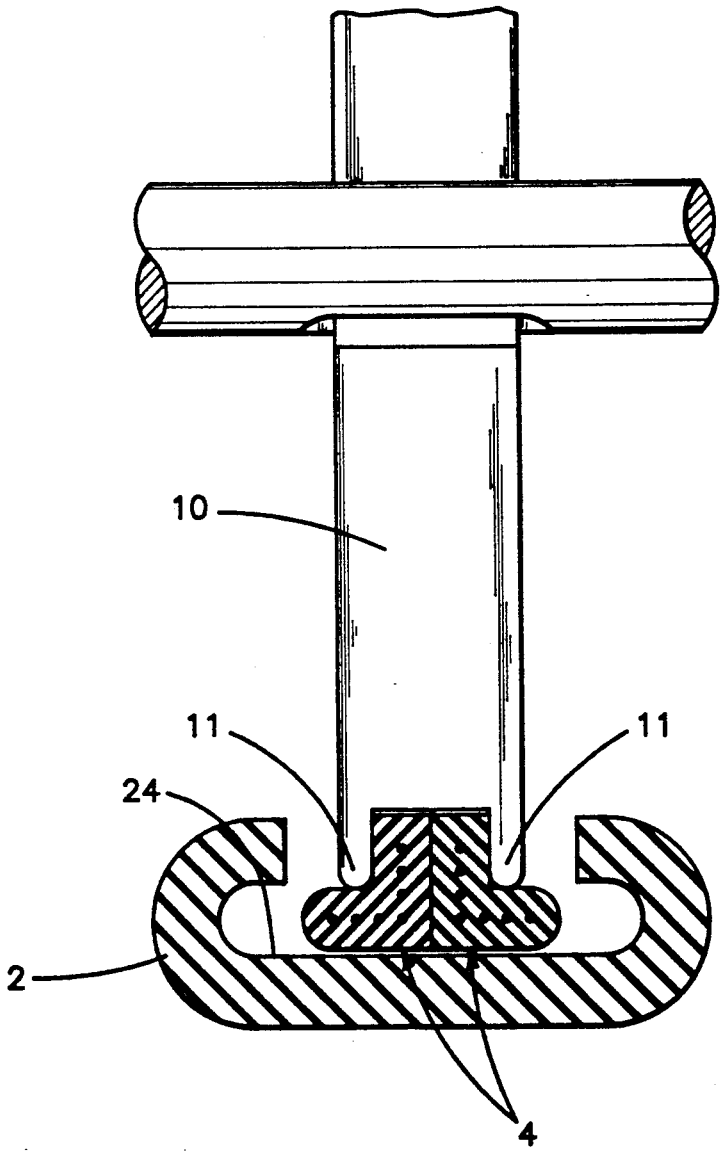
FIG. 2 is a sectional view taken along line 2—2 of FIG. 1.
Figure 3:
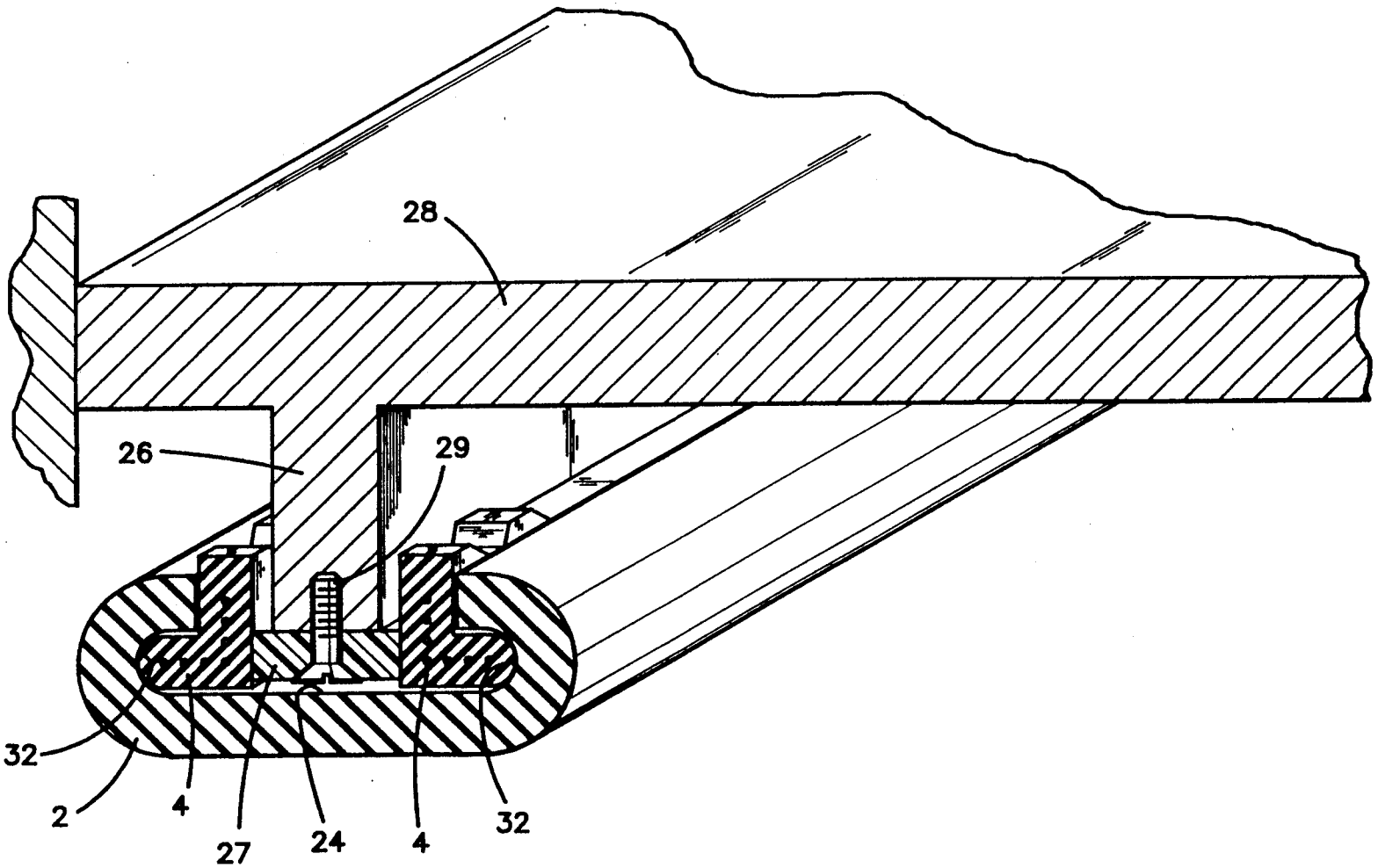
FIG. 3 is a sectional view taken along line 3—3 of FIG. 1.

FIG. 2 shows the position of the drive belts 4 as they approach and leave the two sprockets 10 or 12. The tension imposed on the belts 4 by the spring 20 will cause the belts 4 to be disposed in side-to-side close contact with each other, as shown in FIG. 2. The sprockets 10 and 12 will both preferably be formed with sides 11 which will force the drive belts 4 together so as to reduce the total belt width to ensure smooth entry to and egress from the inside of the handrail. When the belts 4 engage the spreader 26, they will be forced apart, as shown in FIG. 3, and will be wedged into the inner side pockets 32 which are formed on the sides of the handrail 2. The part of the spreader 26 that actually contacts the belts 4 will preferably be a low coefficient of friction bar 27 formed from UHMW polyethylene, PTFE or the like, which is fastened to the spreader 26 with a plurality of screws 29, as shown in FIG. 3. The drive belts 4 will thus be frictionally connected to the handrail 2 so long as the belts 4 move over the spreader 26. The belts 4 will thus pull the handrail along its return path of travel. The forces exerted on the handrail can be varied by varying the extent or length of the spreader 26; and by the composition of the drive belts 4. The contact between the drive belts 4 and the handrail 2 is chiefly in the inner side pockets 32 of the latter, an area which is not provided with a low coefficient of friction surface since it does not substantially contact the handrail guide rails. Thus, a high degree of frictional engagement can be achieved.

It will be readily appreciated that the handrail drive assembly of this invention will preserve the integrity of the handrail and lengthen its service life. The outer exposed surface of the handrail will not be touched by the drive system, and thus the finish and appearance of the handrail will not be marred. The extent of contact between the drive belts and the handrail provides very smooth movement of the handrail. The side radii of the handrail are currently designed for high strength to withstand high transverse (unwrapping) forces, thus providing high resistance to the normal forces imparted by the drive belts. The drive belts can be made by a high coefficient of friction material in the drive surface region, and can be reinforced with Kevlar or the like high strength material. The static drive belt spreader specifically shown in the drawings is the simplest form of spreader to use. It will be understood, however, that other spreader mechanisms could also be used. For example, if the need to minimize friction generated between the drive belts and the spreader were to arise, one could use a belt spreader composed of a plurality of rollers mounted in staggered fashion, which rollers fit snugly inside of the handrail and engage the inner surfaces of the side pockets in the handrail. The rollers engaging opposite sides of the handrail will rotate in opposite directions. Such a rotating spreader will generate minimal friction in the drive system.

Since many changes and variations of the disclosed embodiment of the invention may be made without departing from the inventive concept, it is not intended to limit the invention otherwise than as required by the appended claims.

What is claimed is:

1. A drive assembly for driving the handrail on an escalator or moving walkway, said drive assembly comprising:

a) a drive sprocket operable to provide driving power to said drive assembly;

b) a tension sprocket associated with said drive sprocket, said drive sprocket and tension sprocket being disposed along a return run portion of the handrail;

c) a pair of drive belts reeved about said drive and tension sprockets, said drive sprocket being operable to feed said drive belts into an underneath area of said handrail and between curved side walls of said handrail; and d) spreader means interposed between said drive sprocket and said tension sprocket, said spreader means being operable to engage adjacent inner surfaces in each of said drive belts to laterally separate said drive belts within the handrail, and to force said drive belts against inner surfaces of said handrail side walls so as to establish a frictional driving engagement between said drive belts and the handrail whereby movement of the drive belts imparts movement to the handrail.

2. The drive assembly of claim 1 wherein said drive sprocket and said tension sprocket include side flanges engaging outer side surfaces of said drive belts to ensure proper entry and egress of said drive belts to and from said underneath area of said handrail.

3. The drive assembly of claim 1 wherein said spreader means comprises a plate mounted on a truss portion of the escalator or walkway and depending from said truss portion toward the handrail.

4. The drive assembly of claim 3 wherein said plate comprises a low coefficient of friction member mounted on a location thereon promixal of said handrail, said member engaging said adjacent inner surfaces of said drive belts.

5. The drive assembly of claim 1 wherein opposite ends of said spreader means are tapered to smoothly move said drive belts between their abutting and separated positions.

* * * * *